US009481171B2

(12) United States Patent
Mori et al.

(10) Patent No.: US 9,481,171 B2
(45) Date of Patent: Nov. 1, 2016

(54) ELEMENT SUBSTRATE AND LIQUID DISCHARGE HEAD

(71) Applicant: CANON KABUSHIKI KAISHA, Tokyo (JP)

(72) Inventors: Masao Mori, Kawasaki (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/740,716

(22) Filed: Jun. 16, 2015

(65) Prior Publication Data

US 2015/0367636 A1 Dec. 24, 2015

(30) Foreign Application Priority Data

Jun. 19, 2014 (JP) ..... 2014-126413

(51) Int. Cl.

| | |
|---|---|
| ***B41J 2/38*** | (2006.01) |
| ***B41J 2/335*** | (2006.01) |
| ***B41J 2/34*** | (2006.01) |
| ***B41J 2/14*** | (2006.01) |

(52) U.S. Cl.

CPC ..... *B41J 2/1412* (2013.01); *B41J 2202/11* (2013.01)

(58) Field of Classification Search

None

See application file for complete search history.

(56) References Cited

U.S. PATENT DOCUMENTS

| | | | | |
|---|---|---|---|---|
| 5,831,643 | A * | 11/1998 | Chung | 347/17 |
| 2002/0113840 | A1* | 8/2002 | Trauernicht | B41J 2/03 347/47 |
| 2006/0044347 | A1* | 3/2006 | Kwon | B41J 2/1603 347/44 |
| 2009/0148618 | A1* | 6/2009 | Fish et al. | 427/511 |
| 2009/0160896 | A1 | 6/2009 | Yamagata | |

* cited by examiner

*Primary Examiner* — Erica Lin

(74) *Attorney, Agent, or Firm* — Canon U.S.A., Inc. IP Division

(57) ABSTRACT

An element substrate includes a discharge port that discharges a liquid, an energy-generating element that generates energy that discharges the liquid from the discharge port, an acting chamber that makes the energy of the energy-generating element act on the liquid, and a heating element including at least two heat generating surfaces that are exposed to the liquid inside the acting chamber, the heating element disposed inside the acting chamber. The element substrate further includes a substrate in which a supply port that supplies liquid to the acting chambers is formed. The heating element may be disposed such that the heat generating surfaces are spaced apart from the substrate.

19 Claims, 3 Drawing Sheets

ELEMENT SUBSTRATE AND LIQUID DISCHARGE HEAD

BACKGROUND OF THE INVENTION

1. Field of the Invention

The present disclosure relates to an element substrate that adds discharge energy to a liquid and that discharges the liquid and relates to a liquid discharge head provided with the element substrate.

2. Description of the Related Art

A liquid discharge head that discharges a liquid is required to discharge small droplets each having a volume of 2 pl or smaller, for example. By applying such small droplets on a record medium at high density, an image quality with high definition can be obtained. Due to reduction in size of the droplets, the number of discharges dramatically increases. In increasing the number of discharges, a limitation in the number of discharges is encountered when only the ejection frequency is increased and, as the ejection frequency is increased, an adverse effect in that the discharge speed decreases occurs. In order to avoid reduction in the discharge speed and to discharge a predetermined amount of liquid in a shorter time, an element substrate in which a large number of discharge ports are arranged at high density is employed.

Incidentally, in an element substrate that discharges a liquid, a problem has been met in that the viscosity of the liquid becomes high when the temperature of the liquid decreases. In order to avoid such a problem, a technique has been employed in which the liquid is heated before being supplied to an acting chamber that makes discharge energy act on the liquid. However, in an element substrate that discharges small droplets, due to an increase in viscosity that is caused by increase in the temperature of the liquid, a problem of drop in the discharge characteristics is encountered. In other words, the heated liquid accumulated in the acting chamber evaporates through the discharge port. In the element substrate that discharges small droplets, the amount of liquid that is discharged from each discharge port is small and even with a small amount of solvent evaporation, the viscosity of the liquid easily increases. Furthermore, since the discharge ports and the acting chamber are relatively small, they are easily affected by the increase in the flow resistance of the liquid caused by the increase in viscosity. Such problems are prominent in pigment ink that easily agglomerate or highly functional ink with a high additive resin content.

Increase in the flow resistance causes the discharge characteristics of the element substrate to drop. Due to drop in the discharge characteristics, there are cases in which the element substrate fails to discharge the liquid unless a recovery process is performed in the liquid supply channel from the discharge port to the acting chamber.

US Patent Application Publication Number 2009/0160896 discloses an element substrate that is controlled so that a liquid inside an acting chamber is not heated more than needed.

In the element substrate described in US Patent Application Publication Number 2009/0160896, a heat generation element serving as an energy-generating element preliminarily heats the liquid inside the acting chamber to a predetermined temperature and, then, discharges the liquid after the heat generation element has boiled the liquid. However, it is difficult to rapidly heat the liquid with the quantity of heat of the preliminary heating. Accordingly, when under a low-temperature environment, a long standby time is needed until the liquid is heated to the predetermined temperature with the preliminary heating, and the throughput of the element substrate decreases.

SUMMARY OF THE INVENTION

The present disclosure is directed to an element substrate that enables favorable discharge characteristics that can suppress thickening of the liquid to be obtained.

The present disclosure provides an element substrate that includes a discharge port that discharges a liquid, an energy-generating element that generates energy that discharges the liquid from the discharge port, an acting chamber that makes the energy of the energy-generating element act on the liquid, and a heating element including at least two heat generating surfaces that are exposed to the liquid inside the acting chamber, that is disposed inside the acting chamber such as not to discharge the liquid.

Further features of the present invention will become apparent from the following description of exemplary embodiments with reference to the attached drawings.

DESCRIPTION OF THE EMBODIMENTS

Figure 1:
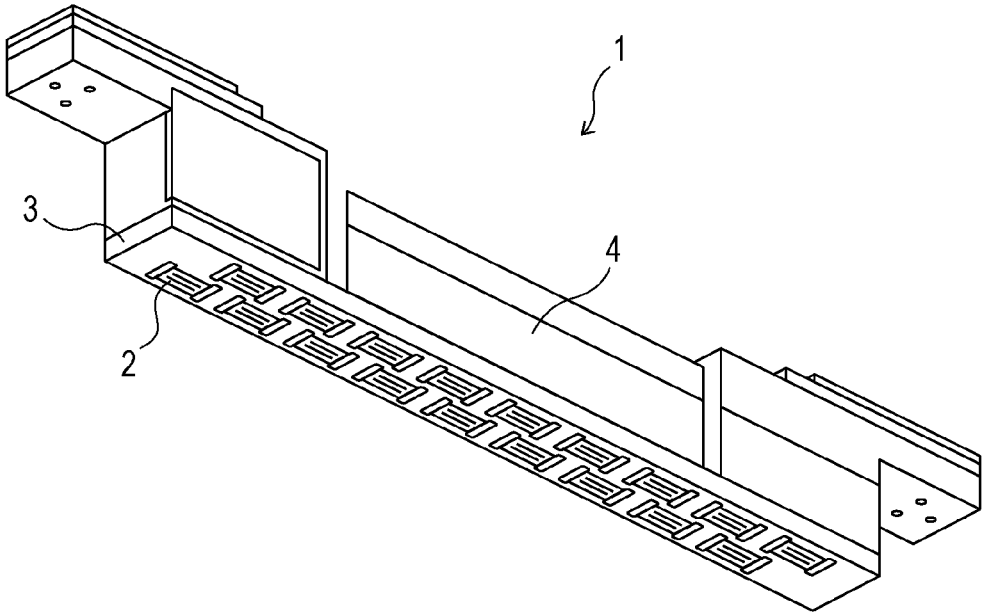
FIG. 1 is a perspective view of a liquid discharge head including element substrates according to an exemplary embodiment of the present disclosure.

Hereinafter, an exemplary embodiment of the present disclosure will be described with reference to the drawings. FIG. 1 is a perspective view of a liquid discharge head including element substrates according to an exemplary embodiment of the present disclosure. As illustrated in FIG. 1, a liquid discharge head 1 includes element substrates 2 that discharge a liquid such as an ink, a support member 3 that supports the element substrates 2, and an electric wiring member 4 that is electrically connected to the element substrates 2. The liquid discharge head 1 illustrated in FIG. 1 can be mounted in a so-called full-line recording apparatus.

Figure 2:
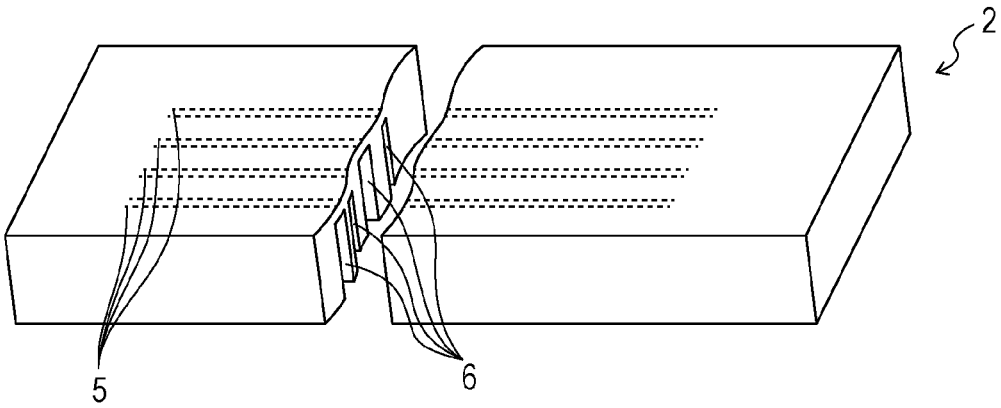
FIG. 2 is a partially cutaway perspective view of an element substrate according to the exemplary embodiment of the present disclosure.

FIG. 2 is a partially cutaway perspective view of an element substrate 2 illustrated in FIG. 1. The element substrate 2 includes discharge ports 5 that are arranged in pairs of rows such that each of the pairs are capable of discharging a corresponding one the four colors of inks, namely, cyan, magenta, yellow, and black.

The inks are supplied from ink tank portions (not shown) to the discharge ports 5 through common liquid chambers 6 each common to the corresponding discharge port rows formed in two rows for each color. The discharge ports 5 adjacent to each other in the row direction are arranged at an array density of 800 dots per inch (dpi). Furthermore, the discharge ports 5 of one of the rows of the same color are arranged so as to be offset by half a pitch with respect to the discharge ports 5 of the other one of the rows of the same color. Accordingly, each of the element substrates 2 is capable of applying ink on the record medium at a recording density of 1600 dpi.

Figure 3:
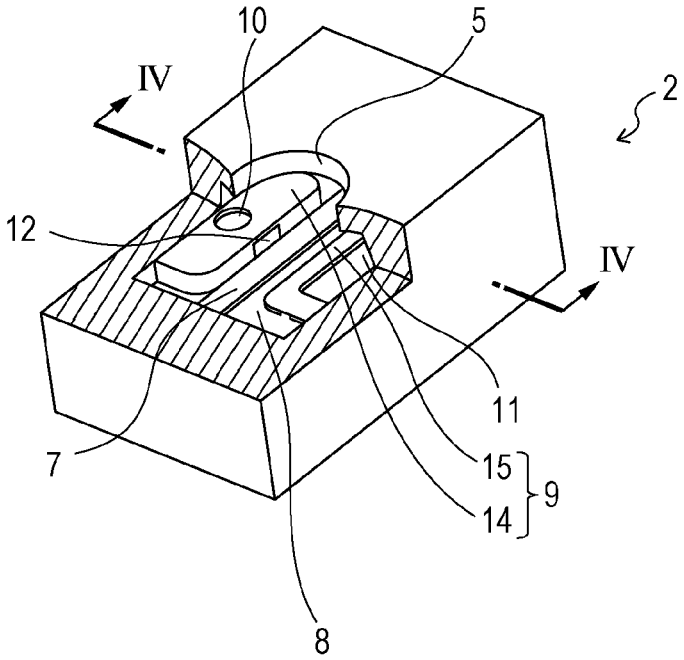
FIG. 3 is a partially cutaway perspective view in which the vicinity of a discharge port of the element substrate illustrated in FIG. 2 has been enlarged.

FIG. 3 is a partially cutaway perspective view in which the vicinity of one of the discharge ports 5 of the element substrates 2 illustrated in FIG. 2 has been enlarged. As illustrated in FIG. 3, the element substrates 2 include heat generation elements 7 and acting chambers 8 for making the energy of the heat generation elements 7 act on the ink. The heat generation elements 7 disposed inside the acting chambers 8 function as energy-generating elements that generate energy for discharging ink from the discharge ports 5.

The acting chambers 8 are in communication with the common liquid chambers 6 (see FIG. 2), and the inks flow from the common liquid chambers 6 into the acting chambers 8. Each ink that has been supplied to the corresponding acting chambers 8 receives thermal energy from the corresponding heat generation elements 7 and undergoes film boiling. As a result, bubbles that are generated in each ink push the ink such that the ink is discharged from the discharge ports 5.

Each heat generation element 7 desirably has a shape having a longitudinal axis (for example, a plate shape, a clinical shape, or a prismatic shape). In the present exemplary embodiment, the heat generation element 7 has a strip-like plate shape. Two ends of the heat generation element 7 are fixed to the walls of the acting chamber 8, and two surfaces of the heat generation element 7 extending along the longitudinal axis are exposed to the ink so as to be capable of heating the ink. Accordingly, heat can be provided to the ink from both surfaces of the heat generation element 7 allowing the ink to undergo film boiling in a shorter time.

Figure 4:
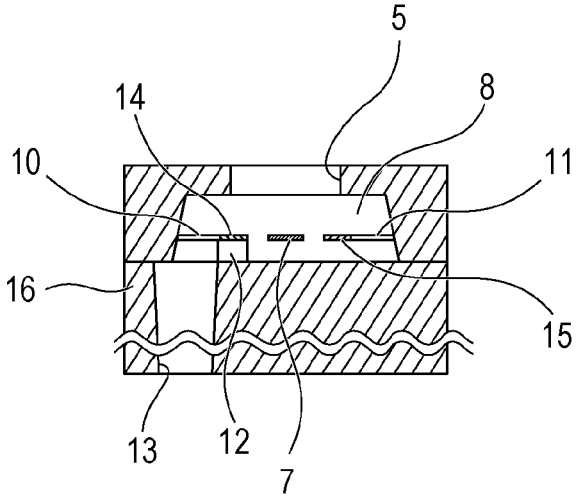
FIG. 4 is a cross-sectional view of the element substrate illustrated in FIG. 3 cut along line IV-IV.

Furthermore, the element substrate 2 includes partitions 9 that are provided on both sides of each heat generation element 7 such that the heat generation element 7 is positioned in between. The partitions 9 are formed of the same material as that of the heat generation element 7 and are fabricated in the process that is the same as the process in which the heat generation element 7 is formed. Accordingly, as illustrated in FIG. 4, the interval between the heat generation element 7 and a substrate 16 and the interval between a heating element 15 and the substrate 16 are substantially the same. The heat generation element 7 and the partitions 9 separate (with a virtual plane that traverses the discharge direction) the acting chamber 8 into an upper space that is formed on the discharge port 5 side and a lower space that is formed on a supply port 13 side (upstream side). One of the partitions 9 extends to the bottom wall (in other words, a wall that opposes the wall in which the discharge port 5 is disposed) and the lower space of the acting chamber 8 is separated by the one of the partitions 9.

The upper and lower spaces formed in the acting chamber 8 are in communication with each other through gaps formed between the heat generation element 7 and the partitions 9, an opening 10 formed in the one of the partitions 9, and a through hole 11 formed in the other one of the partitions 9. Furthermore, the plurality of spaces formed in the lower space of the acting chamber 8 are in communication with each other through an opening 12 formed in the one of the partitions 9.

FIG. 4 is a cross-sectional view of the element substrate 2 illustrated in FIG. 3 cut along line IV-IV. As illustrated in FIG. 4, the substrate 16 that is formed at a position opposing the discharge port 5 is provided with the supply port 13 that is in communication with the acting chamber 8. More specifically, the supply port 13 that penetrates the substrate 16 is in communication with the space defined by the one of the partitions 9. The above space is a closed space, except for the openings 10 and 12, such that the one of the partitions 9 functions as a flow regulating element 14 that regulates the flow of the ink. In the present exemplary embodiment, a plurality of acting chambers 8 are formed in each element substrate 2, and the supply port 13 is individually formed for each acting chamber 8.

The other one of the partitions 9 includes a narrow portion. The narrow portion is electrically connected to an electrode (not shown), and by application of a voltage to the narrow portion through the electrode, the narrow portion generates heat. In other words, the narrow portion functions as the heating element (hereinafter, also referred to as a "sub-heater") 15. The sub-heater 15 is formed so as to be capable of being driven independently with respect to the heat generation element 7. Furthermore, the sub-heater 15 is specified so that no foaming occurs even if driven alone. In other words, the sub-heater 15 can heat the ink to temperatures in which no ink is discharged.

The sub-heater 15 of the present exemplary embodiment has a plate shape having a longitudinal axis and includes at least two heat generating surfaces. In other words, the two main surfaces are heat generating surfaces, and the heat generating surfaces are disposed so as to be spaced apart at a predetermined interval with the substrate 16 such that the two heat generating surfaces are exposed to the ink inside the acting chamber 8. In the present exemplary embodiment, the two ends of the sub-heater 15 are fixed to the walls of the acting chamber 8, and the two surfaces of the sub-heater 15 extending along the longitudinal axis are exposed to the ink so as to be capable of heating the ink. Accordingly, the sub-heater 15 can provide heat to the ink from both surfaces and the escape of heat towards the substrate 16 can be suppressed; accordingly, the ink can be efficiently heated to a predetermined temperature in a shorter time. Note that the sub-heater 15 according to the present disclosure is not limited to the plate shape having a longitudinal axis and, for example, a shape such as a cylindrical shape or a prismatic shape may be applied.

Inks are supplied from the support member 3 (see FIG. 1), which supports the element substrates 2, to the common liquid chambers 6 (see FIG. 2). The common liquid chambers 6 are each in communication with the corresponding supply ports 13, and each ink flows into the corresponding acting chambers 8 from the corresponding common liquid chamber 6 through the corresponding supply ports 13. A circuit (not shown) is formed in each of the element substrates 2 and is electrically connected to a liquid discharge apparatus body (not shown) that is mounted in the liquid discharge head 1.

According to the present exemplary embodiment, the ink inside the acting chamber 8 is heated by the sub-heater 15 when required to be heated. Accordingly, compared to conventional cases in which the whole substrate is heated, since heating can be limited to times when the temperature of the ink needs to be high, the evaporation of the ink from the discharge ports and evaporation of the solvent in the ink can be suppressed. Accordingly, an increase in the viscosity of the liquid can be suppressed. Furthermore, since the sub-heater 15 is provided separately from the heat generation element 7, the ink inside the acting chamber 8 can be heated to a predetermined temperature at an optional timing.

Figure 5:
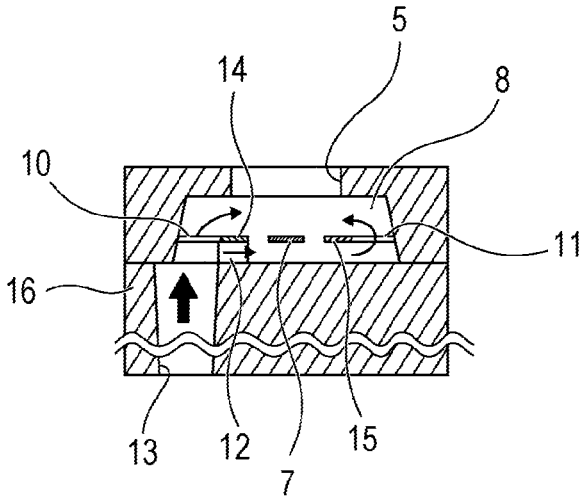
FIG. 5 is a cross-sectional view for describing flows of the liquid.

Flows of the ink from the supply port 13 to the discharge port 5 will be described next by referring to FIG. 5. FIG. 5 is a cross-sectional view illustrating the flows of the ink from the supply port 13 to the discharge port 5.

When the ink is heated by the heat generation element 7, the ink boils on the surfaces of the heat generation element 7. The energy of the boiling ink provides kinetic energy to the surrounding ink such that bubbles are developed. Note that since the flow regulating element 14 defines the closed space, except for the openings 10 and 12, the flow regulating element 14 functions as a flow path resistance that efficiently directs the discharge energy to the ink near the discharge port 5.

After the ink inside the acting chamber 8 is discharged from the discharge port 5, the pressure inside each developed bubble becomes negative. When the inertial force of the ink transmitted during the forming becomes lower than the negative pressure, the bubbles abruptly disappear. As a result, force drawing the ink to the area where the bubbles were present acts on the ink such that the ink flows into the acting chamber 8 from the supply port 13.

At this time, the ink that has been introduced from the supply port 13 first reaches the flow regulating element 14 and, as illustrated by the arrows in FIG. 5, the ink flows into the upper and lower spaces of the acting chamber 8 through the openings 10 and 12 of the flow regulating element 14. With the above flows, a space on the back surface side of the heat generation element 7 (the space on the opposite side of the discharge port 5 side with respect to the heat generation element 7) is replenished with ink.

The liquid that has passed through the back surface side of the heat generation element 7 further flows to the vicinity of the sub-heater 15, passes through the through hole 11, and flows into a space on the front surface side of the heat generation element 7 (the space between the heat generation element 7 and the discharge port 5). In the present description, the channel passing through the through hole 11 and reaching the space on the front surface side is referred to as a "bypass flow path" (see FIG. 5). In other words, the through hole 11 is a part of the bypass flow path, and the sub-heater 15 also serves as a channel wall of the bypass flow path. Due to the ink flowing through the bypass flow path and the opening 10, the space on the front surface side of the heat generation element 7 is replenished with ink.

A configuration of the sub-heater 15 will be described in detail next.

With an aim of suppressing increase in the viscosity of the ink under a low-temperature environment, the related liquid discharge head mainly includes a sub-heater. In such a case, since the liquid discharge head is designed so that the whole liquid discharge head is heated and since it is advantageous from the viewpoint of arrangement and layout, in most cases, the sub-heater is provided in a member with high thermal conductivity such as, for example, a liquid discharge head substrate or a support member that also has a heat dissipating function. With such a configuration, heat is dissipated from the liquid discharge head. Accordingly, the sub-heater is required to provide not only the quantity of heat to heat the entire liquid discharge head but also the quantity of heat amounting to the heat that is dissipated. As a result, a considerably large sub-heater is required. Since it is difficult for such a large sub-heater that is provided, for example, in a member with high thermal conductivity to perform a subtle temperature control, other than when under a normal temperature environment, the heat generation element preliminarily heats the ink to control the temperature of the ink. This is because the discharge amount slightly changes due to the decrease in viscosity under a high-temperature environment resulting in high optical density (OD) of the recorded image. The above phenomenon is prominent in images with high duty. The phenomenon in which the optical density of the recorded image becomes high due to the increase in temperature is further markedly seen in the small droplet discharging environment described above. The above is seen because the rate in which the discharge amount increases with respect to the discharge liquid droplet becomes large.

Furthermore, as described above, the high-temperature environment during small droplet discharge causes thickening caused by evaporation. In other words, the high-temperature environment during small droplet discharge causes, in the short term, decrease in viscosity due to increase in the kinetic energy of the liquid and then, in the long-term, increase in viscosity due to evaporation of moisture in the ink. As described above, in element substrates that discharge small droplets, it is extremely difficult to control the viscosity.

Accordingly, the configuration of the present exemplary embodiment, in which the sub-heater that performs heating on its front and back surface is provided inside the acting chamber, is suitable. When considering heating the needed amount of ink at the needed time, it is preferable to heat the ink between the discharge port and the heat generation element and to prevent, to the extent possible, the ink upstream of the heat generation element from being heated. By doing so, heating can be performed in a short time, ink does not evaporate more than needed, and the backward resistance is secured on the upstream side of the heat generation element such that discharge efficiency is improved. By disposing the heating element 15, which is the sub-heater, downstream of the heat generation element 7 in the flow direction of the liquid in the acting chamber, the ink upstream of the heat generation element 7 is heated as least as possible. Seen from another viewpoint, as illustrated in FIG. 4, the supply port 13 is formed in the substrate 16. The interval between the supply port 13 and the heating element 15 is larger than the interval between the supply port 13 and the heat generation element 7. Due to the above relationship, the liquid that is on the downstream side in the liquid flow direction (on the side that is near the discharge port 5) can be heated and the viscosity thereof can be reduced allowing a favorable discharge to be performed. In more detail, the interval between the supply port 13 and the heating element 15 is smaller than the interval between the supply port 13 and the discharge port 5 and is larger than the interval between the supply port 13 and the heat generation element 7.

In a case in which the heat generation unit and the sub-heater are provided in a member that has high thermal conductivity, the heat generated in the heat generation element and the sub-heater is transmitted not only to the ink but also to the member that has high thermal conductivity. Accordingly, since a sub-heater having a size that has a certain largeness is required and since the area between the heat generation element and the discharge port needs to be large, there are cases in which the above case is unsuitable for an element substrate that discharges a small droplet. Additionally, the heat that has been transmitted to the member with high thermal conductivity is accumulated in the other members in the liquid discharge head. Accordingly, even after the sub-heater has stopped heating the ink, the heat accumulated in the other members may disadvantageously heat the ink. As a result, the heated state continues for a long time and an unnecessary amount of ink is easily evaporated.

In the present exemplary embodiment, the sub-heater 15 has a long plate shape and the short portions of the long plate shape are supported by the walls of the acting chamber 8.

With such a configuration, heat generated in the sub-heater 15 is not easily transmitted to portions other than the ink. Furthermore, since both the front and back heat generating surfaces of the sub-heater 15 are exposed to the ink, the ink can be heated in a further efficient manner.

Furthermore, with such a configuration, compared to the related liquid discharge head, the amount of ink that is heated is outstandingly smaller. Accordingly, the dimension between the heat generation element 7 and the discharge port 5 does not have to be altered in order to add the sub-heater 15.

Furthermore, most of the heat generated by the sub-heater 15 is transmitted to the ink that is to be discharged. Accordingly, the ink is not easily evaporated and the increase in viscosity can be suppressed to the extent possible. Additionally, since the ink inside the acting chamber is heated, prompt adjustment of temperature can be made. Accordingly, compared to the standby time during warming up when only preheating with the heat generation element of the related element substrate is performed, standby time can be shortened as well. The element substrate 2 according to the present exemplary embodiment can widen the temperature range of the ink temperature adjustment and can adjust the temperature promptly; accordingly, correction of discharge variation during printing is facilitated in a greater manner.

In order to bring about the effect of the temperature adjustment performed by the sub-heater 15 in a further effective manner, it is desirable that the heat generation element 7 also adopts a similar configuration to that of the sub-heater 15 in which heating is performed on the front and back surface. If a protective layer is provided on the surface of the heat generation element 7, there are cases in which extra thermal energy is required and in which the accumulated heat in the protective layer affect the temperature control. In view of the temperature control inside the acting chamber 8, it is desirable that the heat generation element 7 and the sub-heater 15 are formed of a material that has sufficient durability without the need of a protective layer. Such a material for the heat generation element 7 and the sub-heater 15 may be an amorphous-based high-resistance material that is based on refractory metal such as TiAlN. Furthermore, the heat generation element 7 and the sub-heater 15 may be configured of a laminate of TiAlN and TiAl.

Furthermore, in view of improving the discharge efficiency, it is desirable that the sub-heater 15 is disposed at a position that can promptly heat the ink in the vicinity of the heat generation element 7 and at a position that is outside the area between the discharge port 5 and the heat generation element 7 that is an area that may disadvantageously affect the discharge. Such a position may be a position on the heat generation element 7 side of the partition 9 forming the bypass flow path.

In the present exemplary embodiment, the supply port 13 is supplied in each of the acting chambers 8 and the flow path length of the supply port 13 is longer than the flow path length from the outlet end of the supply port 13 to the discharge port 5. With such a configuration, a state is reached in which the backward resistance of the ink at the heat generation element 7 is large and the forward resistance of the ink on the discharge port 5 side is small. With the above, combined with the liquid resistance of the supply port 13 that has a predetermined length or longer, a configuration that is suitable for further improving the discharge efficiency can be obtained.

In the present exemplary embodiment, the heat generation element 7 is employed as the energy-generating element for discharging ink; however, a piezo element including a diaphragm may be employed as the energy-generating element. When the energy-generating element is a piezo element, it is preferable that the sub-heater 15 is disposed at a position that is inside the acting chamber 8 and that opposes the piezo element and at a position offset to a fixed portion of the diaphragm on the discharge port 5 side.

While the present disclosure can be applied to any kind of ink, the present disclosure is particularly advantageous for pigment ink that easily agglomerates or highly functional ink with a high additive resin content. It goes without saying that the present disclosure is not limited to an element substrate that discharges ink, and may be applied to an element substrate that discharges a liquid.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-126413, filed Jun. 19, 2014, which is hereby incorporated by reference herein in its entirety.

What is claimed is:

1. An element substrate, comprising:

a discharge port that discharges a liquid;

an energy-generating element that generates energy for discharging the liquid from the discharge port;

an acting chamber for making the energy of the energy-generating element act on the liquid;

a substrate in which a supply port for supplying the liquid to the acting chamber is formed; and a heating element that is fixed to a wall of the acting chamber, constitutes a through hole and includes at least two heat generating surfaces that are exposed to the liquid inside the acting chamber, the at least two heat generating surfaces being a surface facing the discharge port and a surface facing the substrate, and the heating element being disposed inside the acting chamber such as not to discharge the liquid.

2. The element substrate according to claim 1, wherein the heating element has a shape having a longitudinal axis, and wherein the heating element is provided inside the acting chamber while both surfaces of the heating element extending along the longitudinal axis are exposed to the liquid inside the acting chamber.

3. The element substrate according to claim 1, wherein the heating element is provided downstream of the energy-generating element in a flow direction of the liquid inside the acting chamber.

4. The element substrate according to claim 1, wherein the energy-generating element is a heat generation element that has a plate shape having a longitudinal axis, and both surfaces of the heat generation element extending along the longitudinal axis are provided inside the acting chamber while being exposed to the liquid inside the acting chamber.

5. The element substrate according to claim 4, wherein the acting chamber includes a bypass flow path that connects the both sides of the heat generation element, and the heating element is provided in the bypass flow path.

6. The element substrates according to claim 5, wherein the heating element includes a through hole, the through hole constituting a portion of the bypass flow path, and the heating element also serving as a channel wall of the bypass flow path.

7. The element substrate according to claim 1, further comprising:

a plurality of supply ports that are each in communication with a corresponding one of a plurality of the acting chambers, wherein a flow path length of each supply port is longer than a flow path length from an outlet end of the supply port to the discharge port.

8. The element substrate according to claim 1, wherein the energy-generating element and the heating element are formed of a same material.

9. The element substrate according to claim 1, further comprising:

a substrate in which a supply port for supplying the liquid to the acting chamber is formed, wherein an interval between the energy-generating element and the substrate is substantially the same as an interval between the heating element and the substrate.

10. An element substrate, comprising:

a discharge port that discharges a liquid;

an energy-generating element that generates energy for discharging the liquid from the discharge port;

an acting chamber that includes the energy-generating element therein;

a substrate in which a supply port for supplying the liquid to the acting chamber is formed; and a heating element that is fixed to a wall of the acting chamber, constitutes a through hole and is disposed inside the acting chamber, the heating element heating the liquid distributed inside the acting chamber so as not to discharge the liquid, wherein a heat generating surface and a back surface of the heat generating surface of the heating element are disposed so as to be spaced apart from the substrate.

11. The element substrate according to claim 10, wherein the heating element is formed of a plate-shaped member that is provided with a plurality of the heat generating surfaces.

12. The element substrate according to claim 10, wherein the energy-generating element is disposed such that the heat generating surface of the energy-generating element is disposed so as to be spaced apart from the substrate.

13. The element substrate according to claim 10, wherein an interval between the energy-generating element and the substrate is substantially the same as an interval between the heating element and the substrate.

14. The element substrate according to claim 10, wherein an opening that supplies the liquid is formed in the heating element.

15. A liquid discharge head, comprising:

a discharge port that discharges a liquid;

an energy-generating element that generates energy for discharging the liquid from the discharge port;

an acting chamber that includes the energy-generating element therein;

a substrate in which a supply port for supplying the liquid to the acting chamber is formed, the substrate being formed at a position opposing the discharge port; and a heating element that is fixed to a wall of the acting chamber, constitutes a through hole and is disposed inside the acting chamber, the heating element heating the liquid inside the acting chamber so as not to discharge the liquid, wherein a heat generating surface and a back surface of the heat generating surface of the heating element are disposed so as to be spaced apart from the substrate, and wherein an interval between the supply port and the heating element is larger than an interval between the supply port and the energy-generating element.

16. The liquid discharge head according to claim 15, wherein the interval between the supply port and the heating element is smaller than an interval between the supply port and the discharge port.

17. The liquid discharge head according to claim 15, wherein the heating element is disposed so as to be spaced apart from the substrate, and an interval between the heating element and the substrate being substantially the same as an interval between the energy-generating element and the substrate.

18. The liquid discharge head according to claim 15, wherein the acting chamber includes a bypass flow path that connects the both sides of the heat generation element, and the heating element is provided in the bypass flow path.

19. The liquid discharge head according to claim 15, wherein the heating element includes a through hole, the through hole constituting a portion of the bypass flow path, and the heating element also serving as a channel wall of the bypass flow path.

* * * * *